US005820492A

United States Patent [19]

Yamagishi et al.

[11] Patent Number: 5,820,492

[45] Date of Patent: Oct. 13, 1998

[54] GOLF BALL

[75] Inventors: Hisashi Yamagishi; Jun Shindo; Atsushi Nakamura, all of Chichibu, Japan

[73] Assignee: Bridgestone Sports Co., Ltd., Tokyo, Japan

[21] Appl. No.: 892,527

[22] Filed: Jul. 14, 1997

Related U.S. Application Data

[63] Continuation-in-part of Ser. No. 631,198, Mar. 6, 1996, abandoned.

[30] Foreign Application Priority Data

Mar. 6, 1995 [JP] Japan ..... 7-072348

[51] Int. Cl.[6] ..... A63B 37/12; A63B 37/14; A63B 37/06

[52] U.S. Cl. ..... 473/377; 473/372; 473/384

[58] Field of Search ..... 473/372, 373, 473/352, 377, 384

[56] References Cited

U.S. PATENT DOCUMENTS

| | | | |
|---|---|---|---|
| 3,326,869 | 6/1967 | Perrone | 260/82.7 |
| 5,328,959 | 7/1994 | Sullivan | 473/385 X |
| 5,368,304 | 11/1994 | Sullivan et al. | 473/377 |
| 5,452,898 | 9/1995 | Yamagishi et al. | 473/377 |
| 5,490,673 | 2/1996 | Hiraoka | 473/377 |
| 5,497,996 | 3/1996 | Cadorniga | 473/377 |
| 5,601,503 | 2/1997 | Yamagishi et al. | 473/384 |

FOREIGN PATENT DOCUMENTS 0 286 551 10/1988 European Pat. Off. .

*Primary Examiner*—George J. Marlo
*Attorney, Agent, or Firm*—Sughrue, Mion, Zinn, Macpeak & Seas, PLLC

[57] ABSTRACT

A golf ball comprising a solid core, and a cover enclosing the core and having a multiplicity of dimples formed therein has a diameter of 42.70±0.05 mm and a specific gravity of 1.05±0.05. The cover is composed mainly of an ionomer resin and has a Shore D hardness of at least 60, and the dimples satisfy the condition of $0.80 \leqq V_R \leqq 1.16$ wherein $V_R$ is a percent overall dimple volume given by the formula:

$$V_R = \frac{Vs}{\frac{4}{3}\pi R^3} \times 100\%$$

wherein Vs is a sum of the volumes of the dimple spaces each below a circular plane circumscribed by the dimple edge and R is a radius of the ball. The ball has a weight of 40.5 grams to less than 44.5 grams, and a cover thickness of 1.4 to 2.4 mm. The core undergoes a distortion of 2.4 to 4.3 mm under a load of 100 kg. Those golf players with a slow head speed can enjoy the advantages of the ball including an increased flying distance and a pleasant hitting feel.

5 Claims, 3 Drawing Sheets

GOLF BALL

CROSS REFERENCE TO RELATED APPLICATION

This application is a continuation-in-part of application Ser. No. 08/613,198 filed on Mar. 6, 1996, now abandoned, the entire contents of which are hereby incorporated by reference.

BACKGROUND OF THE INVENTION

1. Field of the Invention

This invention relates to a golf ball suitable for those golf players who swing at a relatively low head speed.

2. Prior Art

For golf balls, various proposals have been made for improving their flying distance and hitting feel.

Most of these advanced golf balls target those golf players who swing at a relatively high head speed, that is, experienced players. Then those golf players capable of high head speed swing can take advantage of the advanced balls, enjoying an increased flying distance and a pleasant feeling. However, those golf players who swing at a low speed and are slow in head speed, including beginner, female and senior players cannot take full advantage of the advanced balls.

Usually, players with a slow head speed select softer ones of the advanced balls. Since the softer balls, however, are not originally designed optimum for slow-headspeed players, the balls follow a low trajectory rather than a high trajectory and offer a less pleasant feel upon hitting.

SUMMARY OF THE INVENTION

An object of the present invention is to provide a novel and improved golf ball which is increased in flying distance and gives a pleasant feel when those golf players who are slow in head speed use it.

The present invention is directed to a golf ball comprising a solid core and a cover enclosing the core and having a multiplicity of dimples formed therein. The ball has a diameter of 42.70±0.05 mm and a specific gravity of 1.05±0.05. The cover is formed mainly from an ionomer resin to a Shore D hardness of at least 60. The dimples satisfy the condition of $0.80 \leqq V_R \leqq 1.16$ wherein $V_R$ is a percent overall dimple volume given by the formula:

$$V_R = \frac{Vs}{\frac{4}{3}\pi R^3} \times 100\%$$

wherein Vs is a sum of the volumes of the dimple spaces each below a circular plane circumscribed by the dimple edge and R is a radius of the ball.

Those players who swing at a low head speed of 30 to 40 m/sec., especially about 35 m/sec. take advantage of this ball in games, gaining an increased flying distance and a pleasant feel.

When a golf ball is hit into the air by a club, gravity (g), an aerodynamic lift (L) and an aerodynamic drag (D) act on the flying ball.

$$\text{Lift } L = 1/2\rho V^2 S C_L \quad (1)$$

$$\text{Drag } D = 1/2\rho V^2 S C_D \quad (2)$$

ρ: air density

V: ball velocity

S: ball cross-sectional area $C_L$: lift coefficient $C_D$: drag coefficient

An inertial force F acts on the ball which is expressed by:

$$\text{inertial force } F = mg + D + L \quad (3)$$

wherein the ball has a mass m. Kinetic equations of the golf ball flying through the air are expressed by the equations:

$$m = -D\cos\theta - L\sin\theta \quad (4)$$

$$my = -mg - D\sin\theta + L\cos\theta \quad (5)$$

wherein θ is an in-flight angle of the ball relative to the ground or horizontal plane.

It is understood that as the mass of the ball is reduced, the inertial force is reduced as seen from equation (3), resulting in a reduced flying distance. This is contradictory to the general demand on golf balls for increased flying distances. On the other hand, the gravitational action on the ball is reduced as seen from equation (5), resulting in a higher trajectory.

We have found that for those players who swing at a low head speed, a golf ball having a small specific gravity of 1.05±0.05 is adequate in that the player can hit the ball high so as to follow a high trajectory, when the golf ball has the conventional diameter of 42.70±0.05 mm. However, a lightweight ball is accompanied by a reduction of flying distance as mentioned above. We have found that this problem can be overcome by properly selecting the material and hardness of the cover as well as the percent overall dimple volume $V_R$. By forming the cover mainly from an ionomer resin to a hardness of at least 60 on Shore D scale and the dimples so that they satisfy the condition of $0.80 \leqq V_R \leqq 1.16$, there is obtained a golf ball which gives a pleasant feel upon hitting and can fly a long distance even when hit at a head speed as low as 35 m/sec.

This finding is derived from our investigation of one-piece and two-piece golf balls in comparison. A comparison is made between a ball of one-piece structure based on butadiene rubber and a ball of two-piece structure wherein a solid core of the same material is covered with a cover of a rigid ionomer resin having a Shore D hardness of at least 60, provided that both the balls have an identical outer diameter of 42.70±0.05 mm and an identical specific gravity of 1.05±0.05. The one-piece ball receives a higher spin rate whereas the two-piece ball receives a lower spin rate. The two-piece ball gains a larger launch angle than the one-piece ball. The low spin rate and large launch angle are advantageous especially in the low head speed region. When a golf ball having a specific gravity of 1.05±0.05 and a cover formed mainly from an ionomer resin to a Shore D hardness of at least 60 is shot at a head speed of 45 m/sec., the flying distance is not increased as compared with other golf balls and the hitting feel is unpleasant. When the same golf ball is shot at a head speed of 35 m/sec., the flying distance is significantly increased as compared with other golf balls and the hitting feel is pleasant.

Moreover, the flying distance is synergistically improved when the dimples are formed on the cover having a Shore D hardness of at least 60 so that the dimples satisfy the condition of $0.80 \leqq V_R \leqq 1.16$.

For further improving the flying distance and hitting feel of the golf ball of the invention, it is preferred that the core undergoes a distortion of 2.4 to 4.3 mm under a load of 100 kg and that the cover has a radial thickness of 1.4 to 2.4 mm.

Also the flying distance is further increased when the dimples satisfy the condition: $V_0 \geqq 0.470$. Provided that each dimple has a circular edge, $V_0$ is the volume (Vp) of the dimple space below a circular plane circumscribed by the dimple edge, divided by the volume (Vq) of a cylinder whose bottom is the circular plane and whose height is the maximum depth of the dimple from the bottom (that is, $V_0$=Vp/Vq).

BRIEF DESCRIPTION OF THE DRAWINGS

These and further features of the present invention will be apparent with reference to the following description and drawings, wherein.

DETAILED DESCRIPTION OF THE INVENTION

Figure 1:
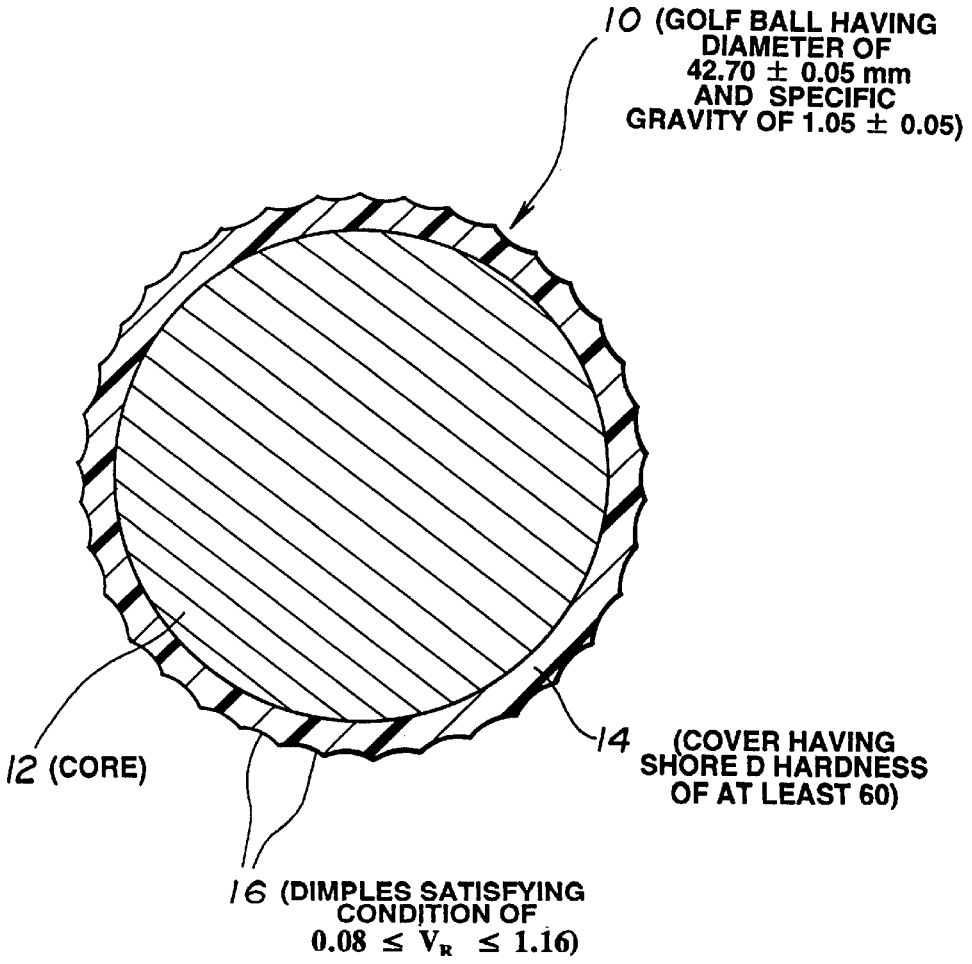
FIG. 1 is a cross sectional view of one embodiment of golf ball according to the present invention.

As shown in FIG. 1, the invention provides a golf ball 10 comprising a cover 14 on a solid core 12. A multiplicity of dimples 16 are formed in the cover. The golf ball of the present invention is adjusted in ball diameter, specific gravity, cover hardness and percent overall dimple volume $V_R$ so that the ball may offer an increased flying distance and a pleasant feel when hit by those players who swing at a relatively low head speed.

The golf ball of the invention is generally a two-piece solid golf ball although it may be a multiple solid golf ball wherein the solid core includes two or more layers. The cover is not limited to a single layer structure and may have a multilayer structure insofar as the above-mentioned requirements are met.

The ball has a diameter of 42.70±0.05 mm and a specific gravity of 1.05±0.05 as mentioned above, preferably from 1.02 to 1.09. A ball having a specific gravity of less than 1.00 is felt light or soft, is likely to receive wind resistance in flight so that its trajectory may be deflected, and is too low in inertial force to cover a long flying distance. On the other hand, a ball having a specific gravity of more than 1.10 is not different from conventional golf balls or usual field-play golf balls, failing to attain the objects of the invention.

The ball should have a weight of not greater than 45.92 g as prescribed in the Rules of Golf. For the objects of the invention, the ball preferably has a weight of 40.5 g to less than 45.0 g, especially 41.0 to 44.5 g.

In the golf ball of the invention, the cover is formed consisting essentially of an ionomer resin to a Shore D hardness of at least 60. The cover hardness is not particularly limited insofar as it is 60 or more on the Shore D scale. Preferably the cover has a Shore D hardness of 62 to 68. If the cover hardness is less than 60 in Shore D, the ball becomes less repulsive and receives a more spin and a larger launch angle upon hitting so that the ball may climb high and stall, failing to cover a long flying distance. Too increased Shore D hardness means that the cover is too hard so that the golf ball may be less durable.

Preferably the cover is formed around the core to a radial thickness of 1.4 to 2.4 mm, especially 1.5 to 2.3 mm. A cover of less than 1.4 mm in thickness would be low in cut resistance so that the ball might be less durable. A cover of more than 2.4 mm in thickness would give a dull feel upon hitting and a ball with such a thick cover would become less repulsive.

Also preferably, the core to be enclosed with the cover undergoes a distortion of 2.4 to 4.3 mm, especially 2.6 to 4.2 mm under an applied load of 100 kg. With a core distortion of less than 2.4 mm, a ball after enclosure with a cover as defined above would give a hard feel upon hitting and be inadequate for golfers with a relatively low head speed. With a core distortion of more than 4.3 mm, the resulting ball would be less repulsive and deteriorated in flying performance. In forming a core, the core should preferably be fully vulcanized to its center to impart restitution to the ball. A core whose interior or center remains unvulcanized is less desirable because the resulting ball becomes less repulsive, short in flying distance, and inferior in hitting feel and durability.

The core may be formed of any desired material by any desired method. Any of well-known materials may be used for the core insofar as a golf ball with desirable properties is obtained.

More particularly, the core of the solid golf ball of the invention is formed by a conventional technique while properly adjusting vulcanizing conditions and formulation. Usually the core is formed of a composition comprising a base rubber, a crosslinking agent, a co-crosslinking agent, and an inert filler. The base rubber may be selected from natural rubber and synthetic rubbers used in conventional solid golf balls. The preferred base rubber is 1,4-polybutadiene having at least 40% of cis-structure. The polybutadiene may be blended with natural rubber, polyisoprene rubber, styrene-butadiene rubber or the like. The crosslinking agent is typically selected from organic peroxides such as dicumyl peroxide and di-t-butyl peroxide, especially dicumyl peroxide. About 0.5 to 3 parts by weight, preferably about 0.8 to 1.5 parts by weight of the crosslinking agent is blended with 100 parts by weight of the base rubber. The co-crosslinking agent is typically selected from metal salts of unsaturated fatty acids, inter alia, zinc and magnesium salts of unsaturated fatty acids having 3 to 8 carbon atoms (e.g., acrylic acid and methacrylic acid) though not limited thereto. Zinc acrylate is especially preferred. About 10 to 45 parts by weight, preferably about 15 to 40 parts by weight of the co-crosslinking agent is blended with 100 parts by weight of the base rubber. Examples of the inert filler include zinc oxide, barium sulfate, silica, calcium carbonate, and zinc carbonate, with zinc oxide being often used. The amount of the filler blended is preferably 0 to about 40 parts by weight per 100 parts by weight of the base rubber although the amount largely varies with the specific gravity of the core and cover, the weight of the ball, and other factors. In the practice of the invention, the amount of the filler is properly selected in a less loading range so as to provide the desired specific gravity and weight to the ball.

A core-forming composition is prepared by kneading the above-mentioned components in a conventional mixer such as a Banbury mixer and roll mill, and it is compression or injection molded in a core mold. The molding is then cured by heating at a sufficient temperature for the crosslinking agent and co-crosslinking agent to function (for example, a temperature of about 130° to 170° C. for a combination of dicumyl peroxide as the crosslinking agent and zinc acrylate as the co-crosslinking agent), obtaining a core.

In the case of a two-layer core, the inner core may be formed of a material similar to the above-mentioned one and the outer core may be formed of a material similar to the above-mentioned one or a resinous material such as an ionomer resin. Typically the outer core is formed over the inner core by compression or injection molding.

Like conventional golf balls, the golf ball of the invention is formed with a multiplicity of dimples in the cover surface. Preferably the ball has about 300 to 550 dimples, more preferably about 360 to 450 dimples. The dimples may be arranged in any desired pattern as in conventional golf balls. There may be two or more types, preferably two to six types, especially two to four types of dimples which are different in diameter and/or depth. It is preferred that the dimples have a diameter of 2.0 to 4.5 mm and a depth of 0.10 to 0.23 mm.

While the inventive golf ball is adequate for those golfers with a slow head speed, a further improvement in the performance associated with a slow head speed is expectable if specific dimples are formed in the cover surface. Specifically, a constant in-flight angle and a stable trajectory are expectable if the dimples are formed to satisfy the condition: $0.80 \leqq V_R \leqq 1.16$, preferably $0.81 \leqq V_R \leqq 1.15$, more preferably $0.82 \leqq V_R \leqq 1.10$. $V_R$ is a percent overall dimple volume given by the formula:

$$V_R = \frac{Vs}{\frac{4}{3}\pi R^3} \times 100\%$$

wherein Vs is a sum of the volumes of the dimple spaces each below a circular plane circumscribed by the dimple edge and the ball has a radius R. If the percent overall dimple volume $V_R$ is less than 0.8%, the in-flight angle would be large so that the ball might climb up and even stall in flight, failing to fly a long distance. If $V_R$ is more than 1.16%, the ball would follow a low trajectory, tend to drop and fail to increase in a flying distance.

It is preferable that the dimples also satisfy the condition: $V_0 \geqq 0.470$, especially $0.475 \leqq V_0 \leqq 0.530$. $V_0$ is defined as follows. It is assumed that each dimple has a circular edge and the ball has a radius R. Then the dimple space below a circular plane circumscribed by the dimple edge has a volume (Vp), and a cylinder whose bottom is the circular plane and whose height is the maximum depth of the dimple from the bottom has a volume (Vq). If $V_0$ exceeds 0.530, the trajectory would tend to descend. If $V_0$ is below 0.470, the ball would climb up.

Figure 2:
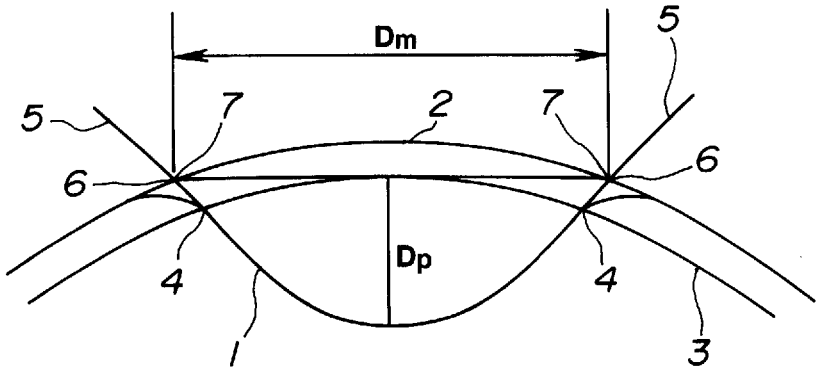
FIGS. 2, 3, and 4 are schematic views illustrating how to calculate the dimple space volume and cylinder volume.
Figure 3:
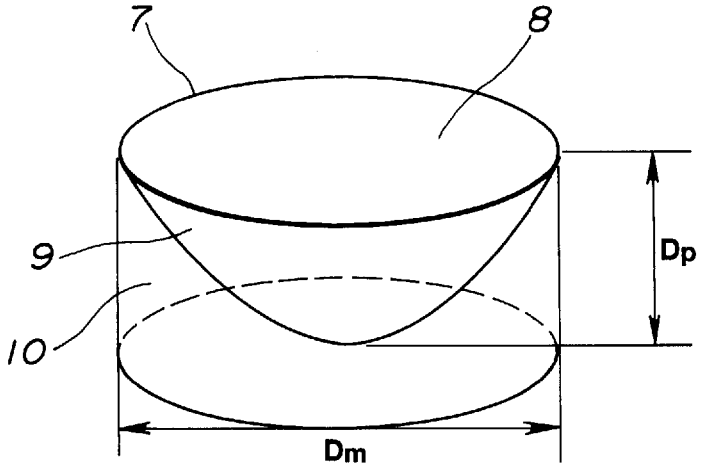
Figure 4:
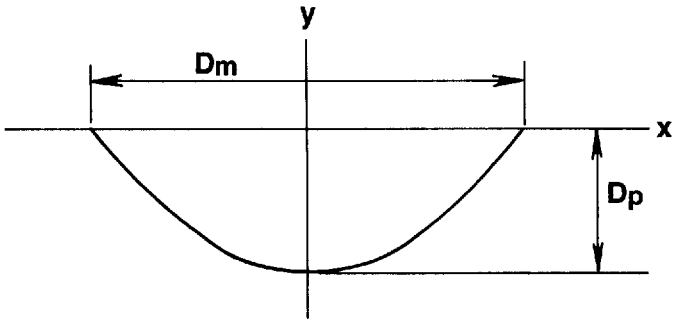

Referring to FIGS. 2 to 4, the shape of dimples is described in further detail. For simplicity sake, it is now assumed that the shape of a dimple projected on a plane is circular. One dimple in a ball surface is shown in the schematic cross-sectional view of FIG. 2. The ball with a radius R has dimples, one of which is depicted at 1, in its spherical surface. In conjunction with the dimple 1, there are drawn a phantom sphere 2 having the ball diameter 2R and another phantom sphere 3 having a diameter smaller by 0.16 mm than the ball diameter. The other sphere 3 intersects with the dimple 1 at a point 4. A tangent 5 at intersection 4 intersects with the phantom sphere 2 at a point 6. A series of intersections 6 define a dimple edge 7. The dimple edge 7 is so defined for the reason that otherwise, the exact position of the dimple edge cannot be determined because the actual edge of the dimple 1 is rounded. The dimple edge 7 circumscribes a circular plane 8 having a diameter Dm. Then as shown in FIG. 3, the dimple space 9 located below the circular plane 8 has a volume Vp. A cylinder 10 whose bottom is the circular plane 8 and whose height is the maximum depth Dp of the dimple from the bottom or circular plane 8 has a volume Vq. As shown in FIG. 4, the volume Vp of the dimple space 9 and the volume Vq of the cylinder 10 are calculated according to the following equations. The dimple space volume Vp is divided by the cylinder volume Vq to give a ratio $V_0$.

$$Vp = \int_0^{\frac{Dm}{2}} 2\pi xy dx$$

$$Vq = \frac{\pi Dm^2 Dp}{4}$$

$$V_0 = \frac{Vp}{Vq}$$

It is noted that an equivalent diameter is used in the event that the shape of a dimple projected on a plane is not circular. That is, the maximum diameter or length of a dimple projected on a plane is determined, the plane projected shape of the dimple is assumed to be a circle having a diameter equal to this maximum diameter or length, and $V_0$ is calculated as above based on this assumption.

The golf ball of the invention for game use is prepared in accordance with the Rules of Golf, that is, to a diameter of 42.70±0.05 mm and a weight of not greater than 45.92 g, preferably 40.5 g to less than 44.5 g. The inventive golf ball has a low specific gravity as specified above while such a low specific gravity is preferably achieved by using a solid core having a low specific gravity or light weight.

EXAMPLE

Examples of the present invention are given below by way of illustration and not by way of limitation. All parts are by weight.

Examples & Comparative Examples

Solid cores as shown in Tables 1 and 2 were prepared by blending the following components.

| Core components | pbw |
|---|---|
| Cis-1,4-polybutadiene rubber (BR01) | 100 |
| Zinc acrylate | 18–35 |
| Zinc oxide | 2–25 |
| Antioxidant | 0.2 |
| Dicumyl peroxide | 0.9 |

Each compound was molded into a core in a mold and heated at 155° C. for about 20 minutes for thoroughly vulcanizing the core. Hardness was adjusted by changing the amounts of zinc acrylate and zinc oxide. Also barium sulfate was used as a gravity adjuster so that the resultant golf balls had the weight shown in Tables 1 and 2.

Cover materials were prepared by blending ionomer resins as shown below. The cover materials were injection molded over the solid cores to produce two-piece solid golf balls as shown in Tables 1 and 2.

Cover materials (1) Shore D hardness 65 a 50/50 (weight ratio) blend of Himilan 1608/Himilan 1706

(2) Shore D hardness 62 and 63 a 50/25/25 (weight ratio) blend of Himilan 1605/Himilan 1706/Himilan 1557

(3) Shore D hardness 58 a 50/50 (weight ratio) blend of Himilan 1605/Surlyn 8120

The two-piece golf balls had an octahedral arrangement of 360 dimples of type A, B or C as shown below.

| | Large size dimple | Small size dimple | Total |
|---|---|---|---|
| Type A | | | |
| Diameter (Dm), mm | 3.75 | 3.50 | |
| Depth (Dp), mm | 0.200 | 0.200 | |
| $V_0$ | 0.480 | 0.480 | |
| Number | 144 | 216 | 360 |
| $V_R$ (%) | | | 0.86 |
| Type B | | | |
| Diameter (Dm), mm | 3.75 | 3.50 | |
| Depth (Dp), mm | 0.170 | 0.170 | |
| $V_0$ | 0.480 | 0.480 | |

-continued

| | Large size dimple | Small size dimple | Total |
|---|---|---|---|
| Number | 144 | 216 | 360 |
| $V_R$ (%) | | | 0.73 |
| Type C | | | |
| Diameter (Dm), mm | 3.75 | 3.50 | |
| Depth (Dp), mm | 0.266 | 0.260 | |
| $V_0$ | 0.500 | 0.500 | |
| Number | 144 | 216 | 360 |
| $V_R$ (%) | | | 1.17 |

Using a swing robot manufactured by True Temper Co., the golf balls were hit by a driver at a head speed (HS) of 35 m/sec. and 45 m/sec. for determining spin, launch angle, carry, total, and in-flight angle. The driver had a loft angle of 10.5° at HS 45 and 12.5° at HS 35.

Using a panel of three male professional golfers (head speed 45 m/sec.) and three female senior players (head speed 35 m/sec.), the balls were evaluated for hitting feel according to the following rating.

◎: pleasant

O: soft

Δ: fairly hard

X: light and too soft

TABLE 1

| | Example | | | | | | Comparative Example | | | | | |
|---|---|---|---|---|---|---|---|---|---|---|---|---|
| | 1 | 2 | 3 | 4 | 5 | 6 | 1 | 2 | 3 | 4 | 5 | 6 |
| Core | | | | | | | | | | | | |
| Outer diameter (mm) | 38.70 | 38.67 | 38.67 | 39.71 | 38.10 | 38.10 | — | 38.70 | 38.70 | — | 38.10 | 38.70 |
| Weight (g) | 31.50 | 32.76 | 34.21 | 35.31 | 31.17 | 31.17 | — | 35.30 | 35.30 | — | 28.62 | 31.50 |
| Hardness[1)] | 2.6 | 3.0 | 3.5 | 3.3 | 3.3 | 4.2 | — | 3.5 | 2.3 | — | 3.3 | 2.6 |
| Cover | | | | | | | | | | | | |
| Thickness (mm) | 2.00 | 2.00 | 2.00 | 1.50 | 2.30 | 2.30 | — | 2.00 | 2.00 | — | 2.30 | 2.00 |
| Hardness[2)] | 63 | 65 | 63 | 62 | 63 | 63 | — | 63 | 63 | — | 63 | 58 |
| Ball | | | | | | | | | | | | |
| Outer diameter (mm) | 42.70 | 42.67 | 42.67 | 42.71 | 42.70 | 42.70 | 42.70 | 42.70 | 42.70 | 42.67 | 42.70 | 42.70 |
| Weight (g) | 41.50 | 42.75 | 44.20 | 43.00 | 42.50 | 42.50 | 43.00 | 45.30 | 45.30 | 39.87 | 39.95 | 41.50 |
| Specific gravity | 1.02 | 1.05 | 1.09 | 1.05 | 1.04 | 1.04 | 1.05 | 1.11 | 1.11 | 0.98 | 0.98 | 1.02 |
| Dimple | Type A | Type A | Type A | Type A | Type A | Type A | Type A | Type A | Type A | Type A | Type A | Type A |
| HS45/#W1 | | | | | | | | | | | | |
| Spin (rpm) | 2800 | 2550 | 2410 | 2510 | 2430 | 2310 | 3265 | 2630 | 2950 | 3210 | 2390 | 2900 |
| Launch angle (°) | 9.6 | 9.9 | 10.1 | 9.9 | 10.1 | 10.2 | 9.1 | 9.8 | 9.6 | 9.21 | 10.2 | 9.4 |
| Carry (m) | 212.5 | 213.0 | 213.4 | 213.2 | 213.0 | 212.9 | 210.7 | 213.5 | 214.0 | 20.85 | 209.0 | 212.5 |
| Total (m) | 222.8 | 223.0 | 224.5 | 224.0 | 223.2 | 229.7 | 220.5 | 226.4 | 225.5 | 218.6 | 219.3 | 225.0 |
| Angle (°) | 12.8 | 12.7 | 12.5 | 12.6 | 12.7 | 12.7 | 12.7 | 12.3 | 12.4 | 12.9 | 12.8 | 12.9 |
| Feel | Δ or x | x | x | x | x | x | Δ or x | ◎ | ○ | Δ or x | x | ○ |
| HS35/#W1 | | | | | | | | | | | | |
| Spin (rpm) | 3360 | 3060 | 2892 | 3012 | 2916 | 2713 | 3918 | 3156 | 3540 | 3852 | 2868 | 3480 |
| Launch angle (°) | 10.7 | 11.0 | 11.2 | 11.0 | 11.2 | 11.4 | 10.2 | 10.9 | 10.7 | 10.3 | 11.3 | 10.5 |
| Carry (m) | 146.5 | 147.0 | 147.5 | 147.0 | 146.5 | 147.1 | 143.0 | 143.5 | 144.0 | 142.0 | 143.4 | 144.1 |
| Total (m) | 157.0 | 157.5 | 158.2 | 158.0 | 157.5 | 158.8 | 150.2 | 154.0 | 153.5 | 149.5 | 153.8 | 154.0 |
| Angle (°) | 13.4 | 13.3 | 13.1 | 13.2 | 13.3 | 13.4 | 13.3 | 12.9 | 13.0 | 13.5 | 13.4 | 13.5 |
| Feel | ◎ | ◎ | ◎ | ◎ | ◎ | ◎ | ◎ | ○ | Δ | ◎ | ◎ | Δ |

[1)]distortion (mm) under an applied load of 100 kg

[2)]Shore D hardness

TABLE 2

| | Example | Comparative Example | | Example | Comparative Example | |
|---|---|---|---|---|---|---|
| | 7 | 7 | 8 | 8 | 9 | 10 |
| Core | | | | | | |
| Outer diameter (mm) | 38.70 | 38.70 | 38.70 | 38.67 | 38.67 | 38.67 |
| Weight (g) | 31.50 | 31.50 | 31.50 | 32.76 | 32.76 | 32.76 |
| Hardness[1)] | 2.6 | 2.6 | 2.6 | 3.0 | 3.0 | 3.0 |
| Cover | | | | | | |
| Thickness (mm) | 2.00 | 2.00 | 2.00 | 2.00 | 2.00 | 2.00 |
| Hardness[2)] | 63 | 63 | 63 | 65 | 65 | 65 |
| Ball | | | | | | |
| Outer diameter (mm) | 42.70 | 42.70 | 42.70 | 42.67 | 42.67 | 42.67 |
| Weight (g) | 41.50 | 41.50 | 41.50 | 42.75 | 42.75 | 42.75 |
| Specific gravity | 1.02 | 1.02 | 1.02 | 1.05 | 1.05 | 1.05 |
| Dimple | Type A | Type B | Type C | Type A | Type B | Type C |
| HS45/#W1 | | | | | | |
| Spin (rpm) | 2800 | 2810 | 2795 | 2550 | 2450 | 2560 |
| Launch angle (°) | 9.6 | 9.5 | 9.6 | 9.9 | 9.9 | 9.8 |
| Carry (m) | 212.5 | 211.6 | 209.0 | 213.0 | 211.0 | 208.5 |
| Total (m) | 222.8 | 219.7 | 216.7 | 223.0 | 220.0 | 216.0 |
| Angle (°) | 12.8 | 13.4 | 12.2 | 12.7 | 13.3 | 12.1 |
| Feel | Δ or x | Δ or x | Δ or x | x | x | x |
| HS35/#W1 | | | | | | |
| Spin (rpm) | 3360 | 3400 | 3350 | 3060 | 3000 | 3050 |
| Launch angle (°) | 10.7 | 10.7 | 10.8 | 11.0 | 11.1 | 11.2 |
| Carry (m) | 146.5 | 145.5 | 141.5 | 147.0 | 146.0 | 142.0 |
| Total (m) | 157.0 | 154.0 | 151.5 | 157.5 | 154.5 | 153.0 |
| Angle (°) | 13.4 | 13.9 | 12.9 | 13.3 | 13.8 | 12.8 |
| Feel | ⊙ | ⊙ | ⊙ | ⊙ | ⊙ | ⊙ |

[1)]distortion (mm) under an applied load of 100 kg
[2)]Shore D hardness

There has been described a golf ball having a diameter, a specific gravity, a cover hardness, and a percent overall dimple volume $V_R$ in the above-defined range. Those golf players with a relatively slow head speed can enjoy the advantages of the ball including an increased flying distance and a pleasant hitting feel.

Japanese Patent Application No. 72348/1995 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A golf ball comprising a solid core and a cover enclosing the core and having a multiplicity of dimples formed therein, said ball having a diameter of 42.70±0.05 mm and a specific gravity of 1.05±0.05, said cover being composed mainly of an ionomer resin and having a Shore D hardness of at least 60, and said dimples satisfying the condition of $0.80 \leqq V_R \leqq 1.16$ wherein $V_R$ is a percent overall dimple volume given by the formula:

$$V_R = \frac{Vs}{\frac{4}{3}\pi R^3} \times 100\%$$

wherein Vs is a sum of the volumes of the dimple spaces each below a circular plane circumscribed by the dimple edge and R is a radius of the ball.

2. The golf ball of claim 1 wherein said cover has a radial thickness of 1.4 to 2.4 mm.

3. The golf ball of claim 1 wherein said core undergoes a distortion of 2.4 to 4.3 mm under a load of 100 kg.

4. The golf ball of claim 1 wherein the dimples satisfy the following condition:

$$V_0 \geqq 0.470$$

wherein $V_0$ is the volume of the dimple space below a circular plane circumscribed by the dimple edge, divided by the volume of a cylinder whose bottom is said circular plane and whose height is the maximum depth of the dimple from the bottom.

5. The golf ball of claim 1 which has a weight of 40.5 g to less than 44.5 g.

* * * * *